US007722014B2

(12) United States Patent
Godwin

(10) Patent No.: US 7,722,014 B2
(45) Date of Patent: May 25, 2010

(54) SURFACE MOUNT

(75) Inventor: Aaron Godwin, Hatboro, PA (US)

(73) Assignee: Jerith Manufacturing Company, Inc., Philadelphia, PA (US)

( * ) Notice: Subject to any disclaimer, the term of this patent is extended or adjusted under 35 U.S.C. 154(b) by 15 days.

(21) Appl. No.: 12/051,453

(22) Filed: Mar. 19, 2008

(65) Prior Publication Data

US 2009/0134289 A1 May 28, 2009

Related U.S. Application Data

(63) Continuation of application No. 29/297,983, filed on Nov. 26, 2007, now Pat. No. Des. 599,915.

(51) Int. Cl.
*E04H 17/22* (2006.01)

(52) U.S. Cl. ..... 256/65.14; 52/297; 248/523

(58) Field of Classification Search ..... 256/65.14, 256/65.16, 67, 68, 70; 248/511, 519, 538, 248/523; 52/296–298, 127.2
See application file for complete search history.

(56) References Cited

U.S. PATENT DOCUMENTS

| | | | | |
|---|---|---|---|---|
| 3,570,414 | A | 3/1971 | Miller | |
| 3,653,169 | A * | 4/1972 | Jenner | 52/298 |
| 4,104,000 | A * | 8/1978 | Fleischmann | 403/7 |
| 4,279,529 | A * | 7/1981 | Lande et al. | 403/246 |
| 4,793,111 | A | 12/1988 | Shewchuk | |
| 5,029,820 | A * | 7/1991 | Katz | 256/59 |
| D348,738 | S | 7/1994 | Jasinsky | |
| 5,499,885 | A | 3/1996 | Chapman | |
| 5,566,926 | A * | 10/1996 | Voigt | 256/13.1 |
| 5,632,464 | A * | 5/1997 | Aberle | 248/530 |
| 5,901,525 | A * | 5/1999 | Doeringer et al. | 52/835 |
| 6,213,452 | B1 * | 4/2001 | Pettit et al. | 256/59 |
| 6,324,800 | B1 | 12/2001 | Valentz et al. | |
| 6,336,620 | B1 * | 1/2002 | Belli | 248/519 |
| 6,718,710 | B2 | 4/2004 | Platt | |
| 6,857,808 | B1 | 2/2005 | Sugimoto et al. | |
| 6,948,283 | B2 * | 9/2005 | Burkart et al. | 52/155 |
| D513,536 | S | 1/2006 | Walker | |
| 6,994,327 | B2 | 2/2006 | Steffes | |
| 7,104,525 | B2 | 9/2006 | Ricci | |
| 7,191,573 | B1 * | 3/2007 | Newton, II | 52/834 |
| D547,463 | S | 7/2007 | Gross et al. | |
| 7,243,473 | B2 * | 7/2007 | Terrels | 52/843 |
| 7,530,550 | B2 * | 5/2009 | Fattori | 256/65.05 |
| 7,543,415 | B2 * | 6/2009 | Svendsen | 52/170 |
| 2004/0025460 | A1 * | 2/2004 | Terrels | 52/298 |
| 2006/0169966 | A1 | 8/2006 | Platt | |

FOREIGN PATENT DOCUMENTS

| | | |
|---|---|---|
| WO | WO 01/90509 | 11/2001 |

* cited by examiner

*Primary Examiner*—Daniel P Stodola
*Assistant Examiner*—Joshua T Kennedy
(74) *Attorney, Agent, or Firm*—Volpe and Koenig, P.C.

(57) ABSTRACT

A surface mount includes a base for receiving a hollow object that is to be secured with the mount to another surface. The interior area includes a movable anchor than can be advanced toward the wall that defines a hollow object receiving area, so that a hollow object is pinched or compressed between the anchor and its respective wall.

10 Claims, 9 Drawing Sheets

FIG. 4
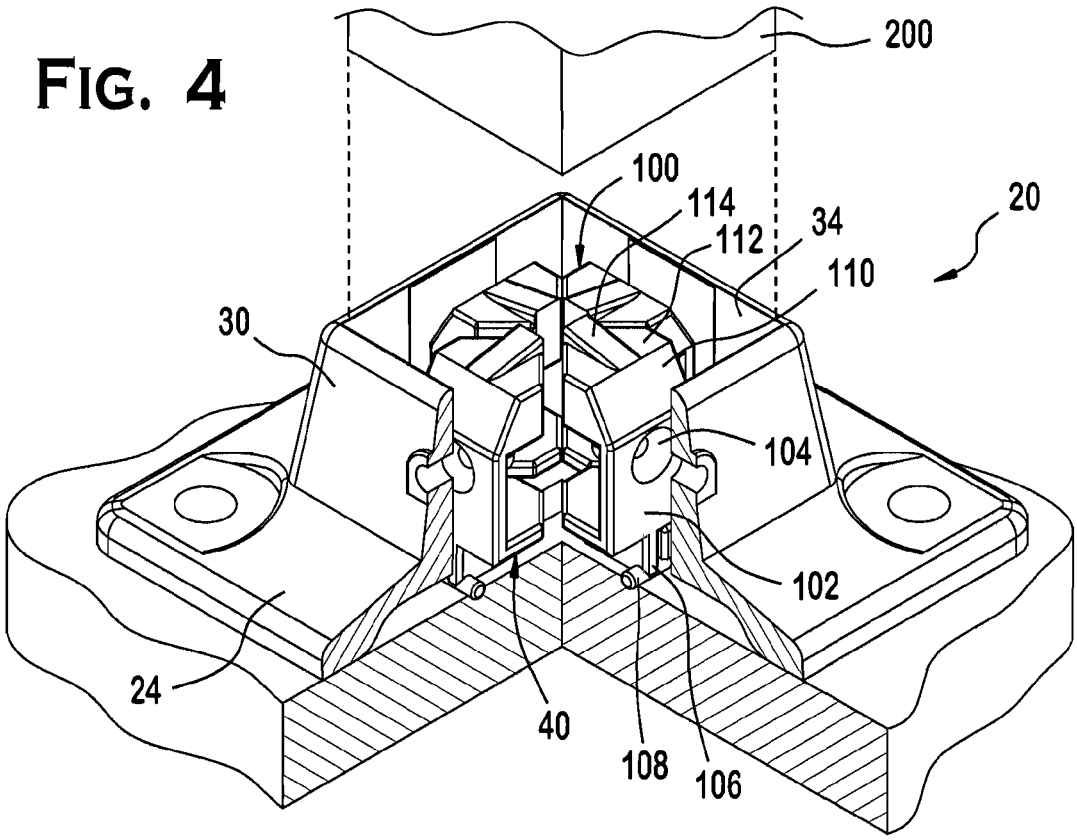
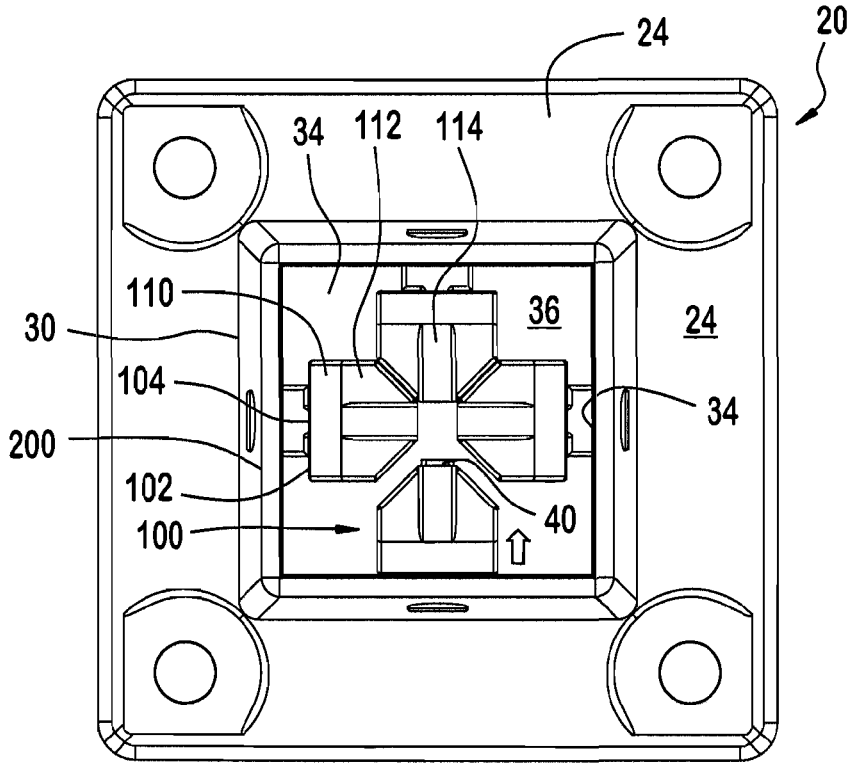
FIG. 5

FIG. 8
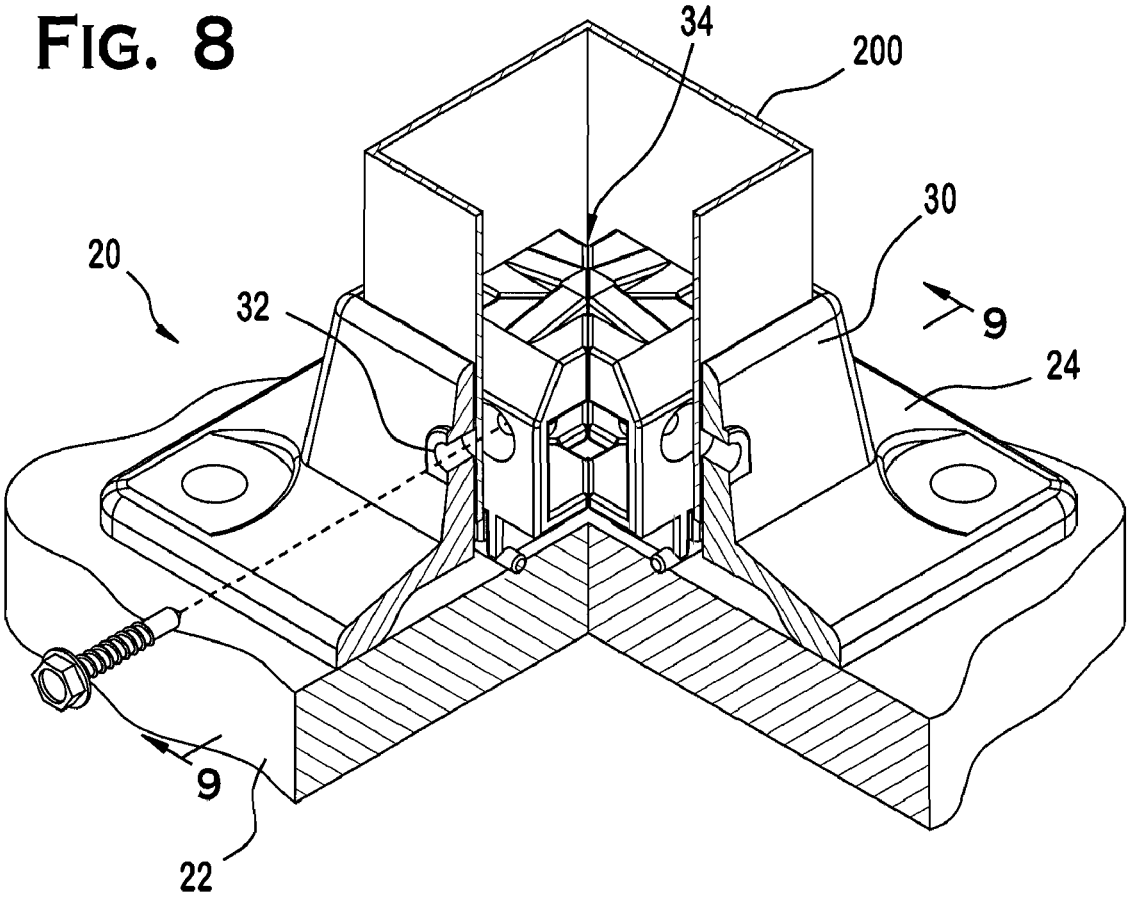
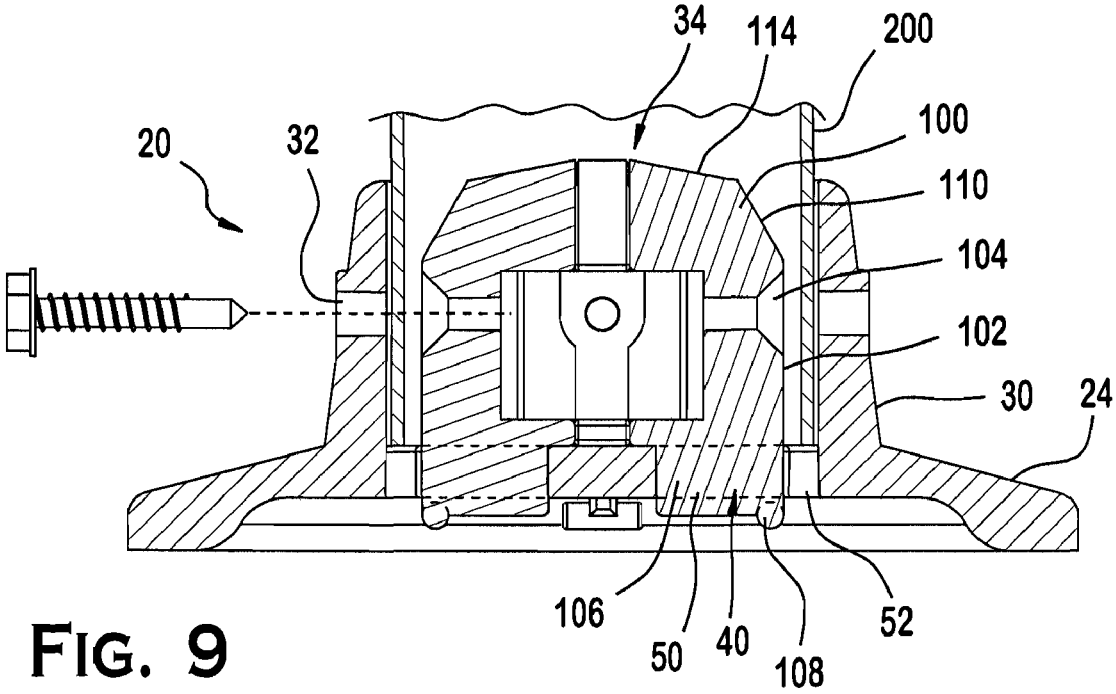
FIG. 9

FIG. 10
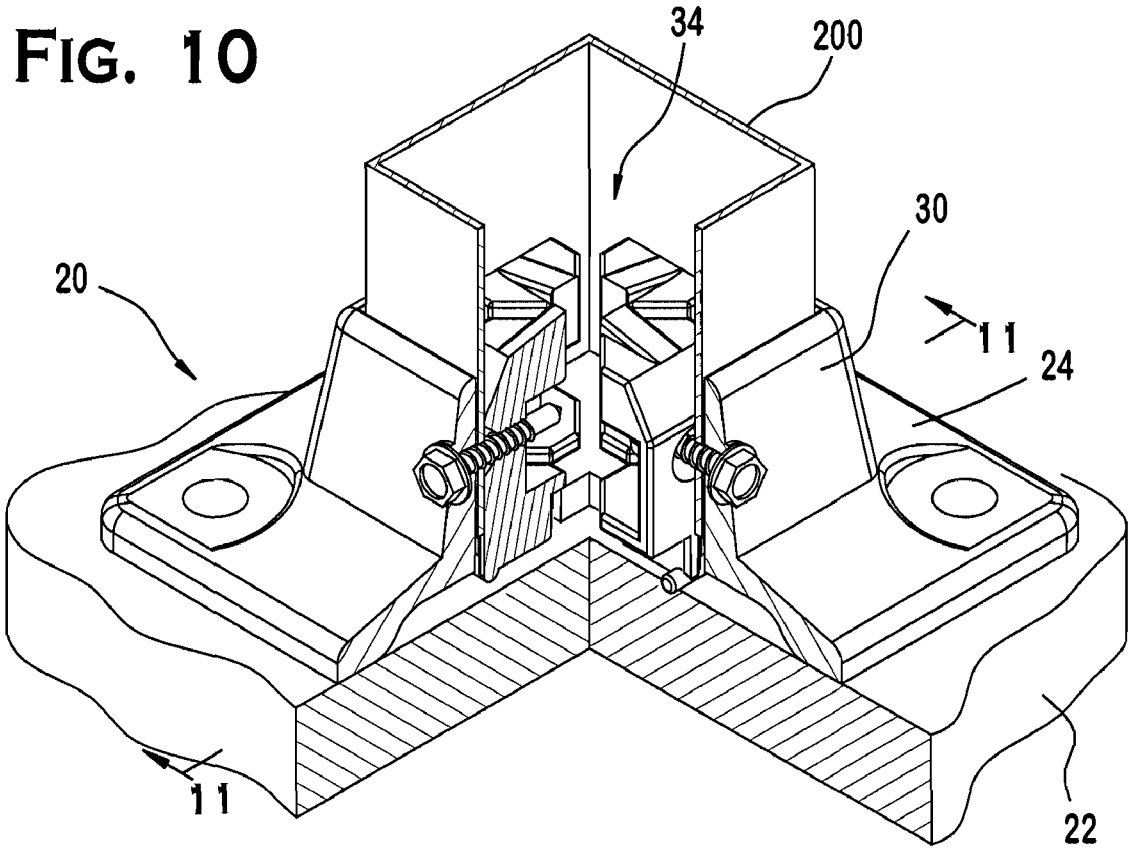
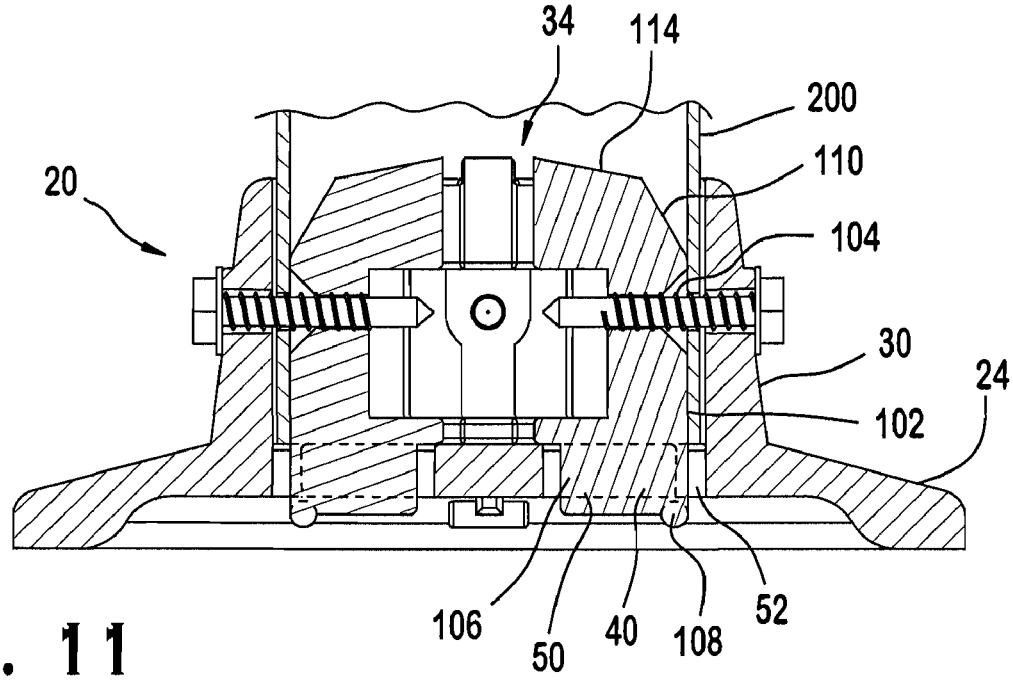
FIG. 11

SURFACE MOUNT

CROSS REFERENCE TO RELATED APPLICATION(S)

This application is a continuation of the prior U.S. patent application Ser. No. 29/297,983 which was filed on Nov. 26, 2007 and is incorporated herein by reference as if fully set forth herein.

FIELD OF INVENTION

This invention relates generally to a device for surface mounting a hollow object on a surface. This invention relates more particularly to mounting a hollow object on a flat surface. This invention relates most particularly to mounting a fence post on a solid surface.

BACKGROUND

There have been a number of attempts to provide surface mounts for securing hollow objects to the surface. While a number of these have been found useful, there are still problems with the endurance of the connection between the mount and the hollow object. It has been found that one cause of failure between the mount and the object has been the failure to restrain movement of the object within the mount.

SUMMARY

The invention is a mount comprised of a base for receiving a hollow object that is to be secured. The interior area includes a movable anchor than can be advanced toward a wall that defines the hollow object receiving area so that the hollow object is pinched or compressed between the anchor and its respective wall. In one particular application, the hollow object is a fence post, which is most commonly rectangular or square. However, the post may be round or of another shape. The anchor members are shaped to complement the interior shape of the hollow object that is to be secured. The hollow object is inserted into the base in the space between the anchors and the walls of the base. A fastener is passed through the wall and the hollow object and into the anchor. As the fastener is tightened, the anchor moves toward the object and compress it between the wall and the anchor. This results in the hollow object being retained by both the fastener which passes through it and the pinching or compressing force against the wall.

BRIEF DESCRIPTION OF THE DRAWING(S)

FIG. 4 illustrates the anchors positioned in the interior portion of the surface mount to define a space between them and the walls for receipt of the hollow object;

FIG. 5 is a top plan view that illustrates three anchors in interior positions that are spaced from the base walls, like FIG. 4, and one anchor that is in the insertion position adjacent to a wall and prior to being moved to the interior position;

FIGS. 8 through 11 illustrate the assembly steps that are associated with a square hollow object or fence post in the mount of the invention;

DETAILED DESCRIPTION OF THE PREFERRED EMBODIMENT(S)

Figure 1:
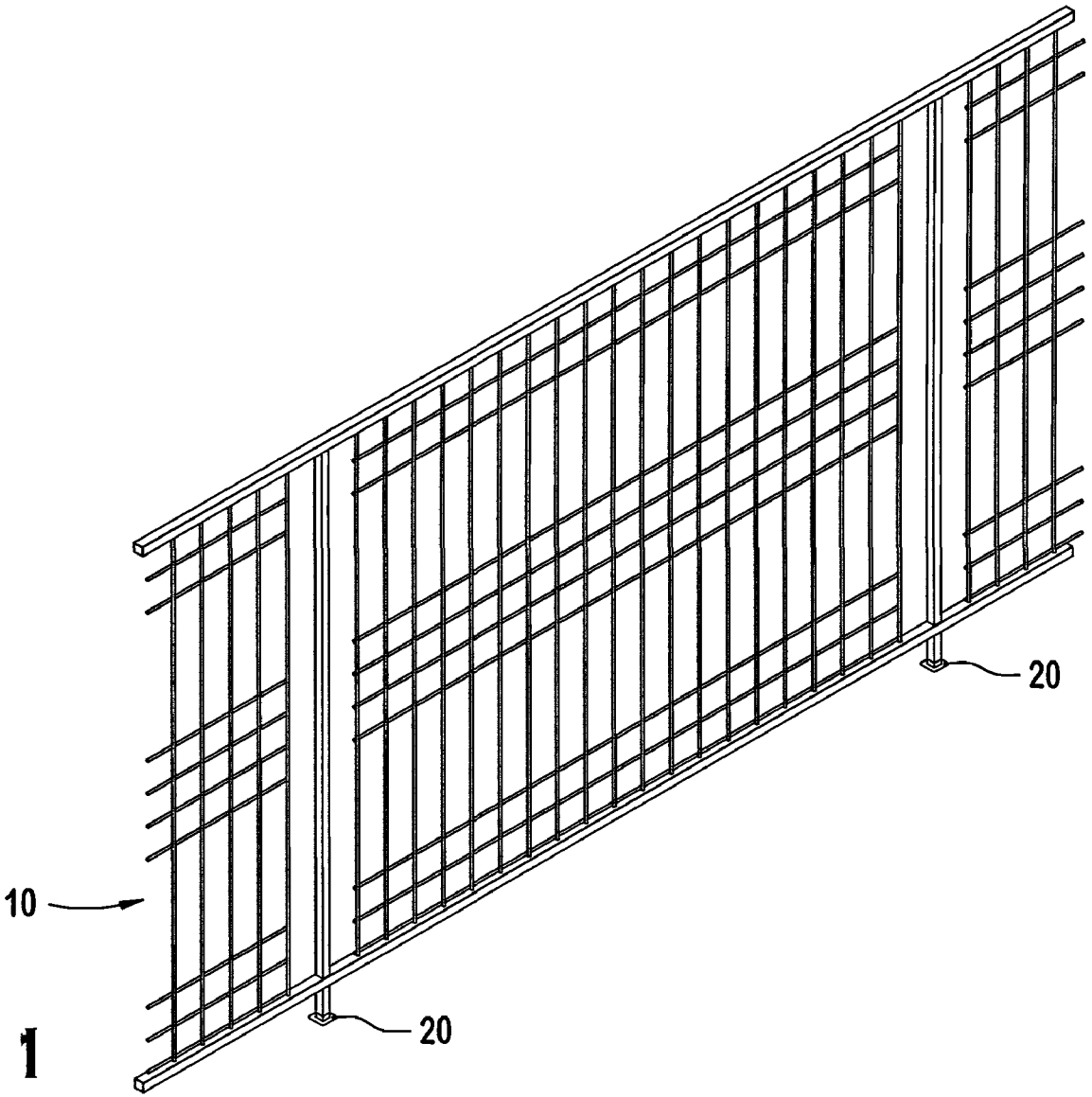
FIG. 1 is a general illustration of a fence assembly.
Figure 2:
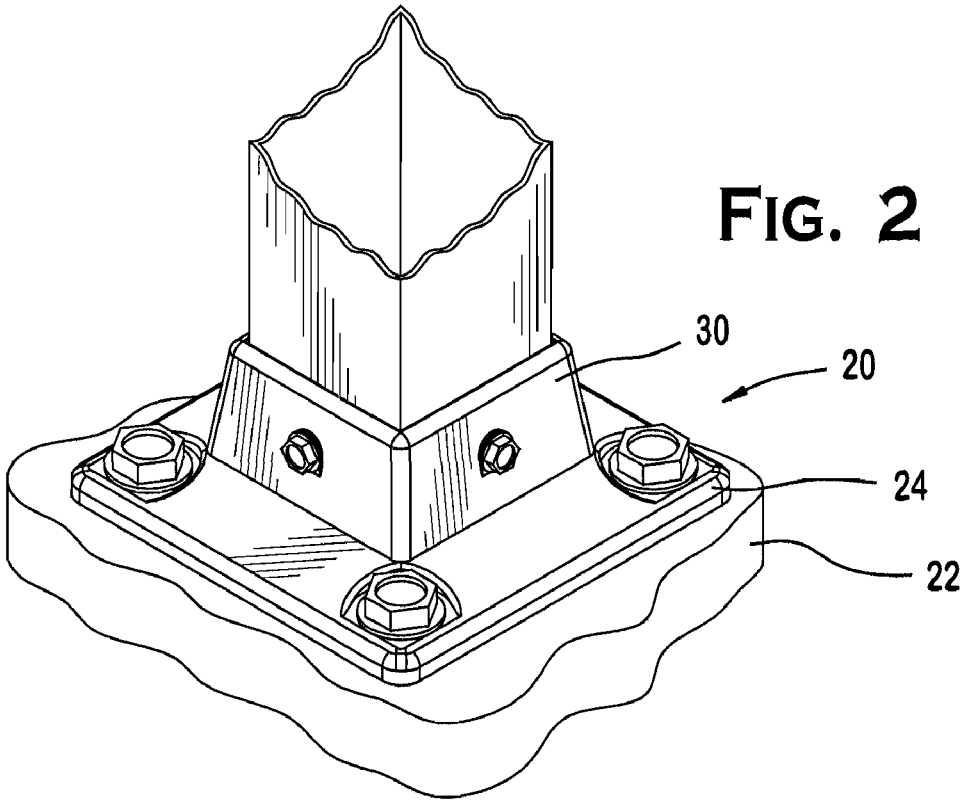
FIG. 2 illustrates a surface mount with a square hollow object inserted in the interior of the surface mount.
Figure 3:
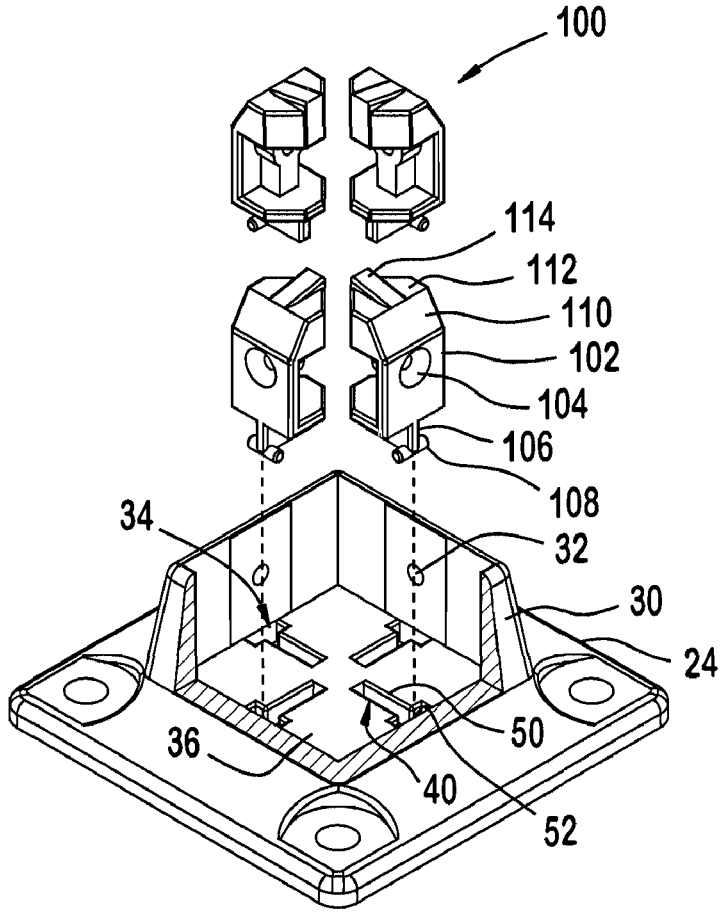
FIG. 3 is an exploded, partial section of the surface mount with the anchors exploded out to reveal the slots in the base of the surface mount.

Referring now to the drawing figures, the invention will be described in detail. FIG. 1 is a generalized view of a fence 10 that generally illustrates the position of the surface mounts 20 in a preferred application. However, the specific type of fence is not part of the present invention. With reference to FIGS. 2 and 3, the surface mount 20 is fastened to a surface 22, such as concrete, with a plurality of fasteners, which may be bolts, rivets, rods or other means of attachment suitable for the application. The surface mount has a base 24 and walls 30 that define an interior cavity 34. The floor 36 of the interior cavity 34 has a plurality of slots 40 that are configured to receive anchors 100.

The preferred geometry of the anchors 100 is fully illustrated in FIGS. 12 through 20. Generally, the anchors 100 have a face 102 with a fastener aperture 104, a lower vertical guide rail 106 that carries a depend retainer 108. Above the face 102, there is a slanted surface 110 which terminates in flat surfaces 112 and the ramp 114. The geometry of the anchor 100 is designed to keep the anchor balanced and to focus the weight of the anchor 100 over the centerline of the anchor 100 with a low center of gravity. This resistance to tilting of the anchor 100 improves its movement through the slots 40 when it is being drawn in to compress the inserted object 200 between the anchor 100 and the wall 30.

Figure 6:
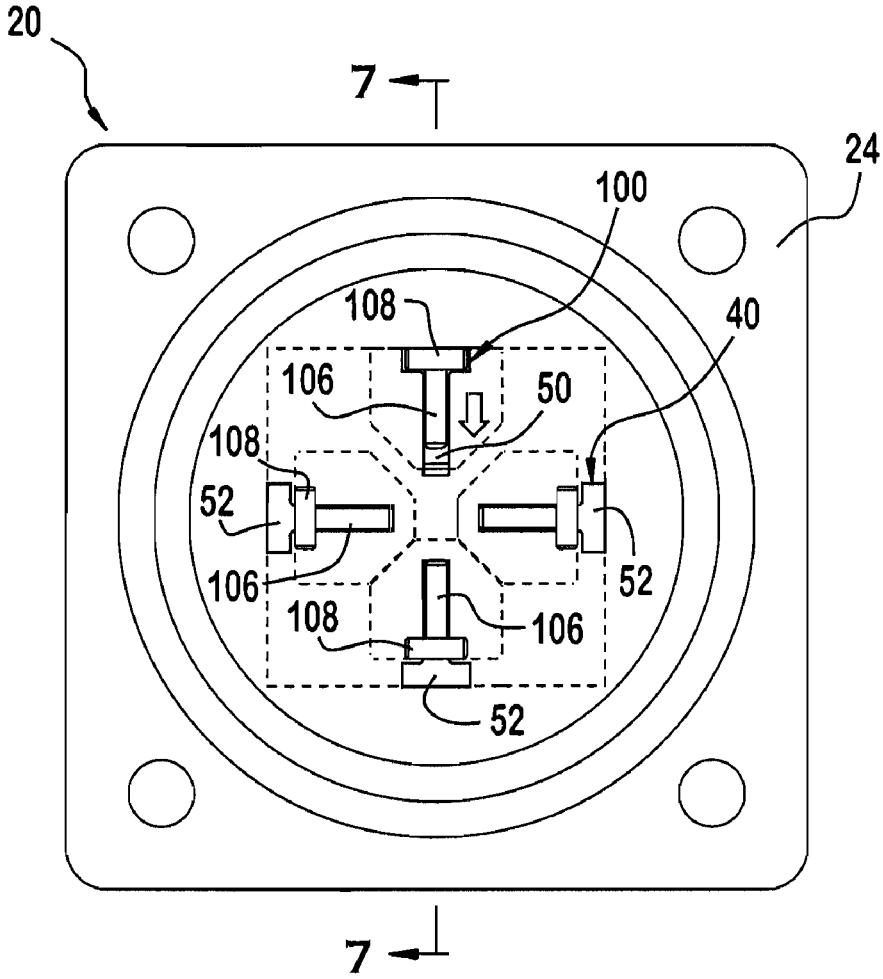
FIG. 6 is a bottom plan view that illustrates the arrangement of the slots within which the anchors are moved from the insertion position into the interior position.
Figure 7:
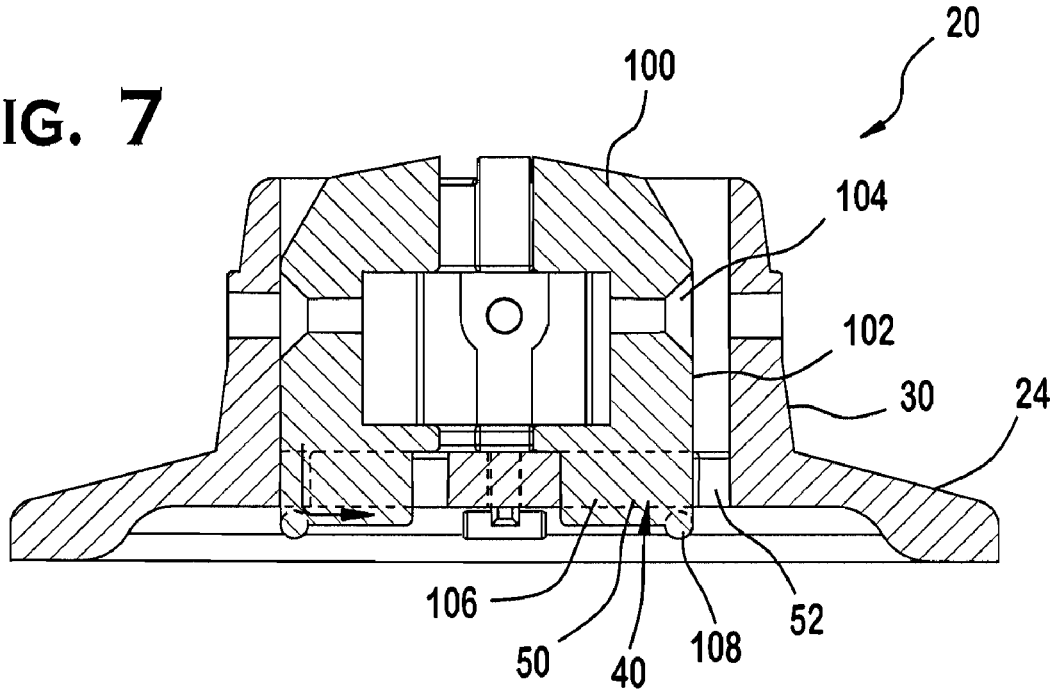
FIG. 7 is a section through the line 7-7 of FIG. 6 that shows one anchor in the insert position and one in the interior position.
Figure 12:
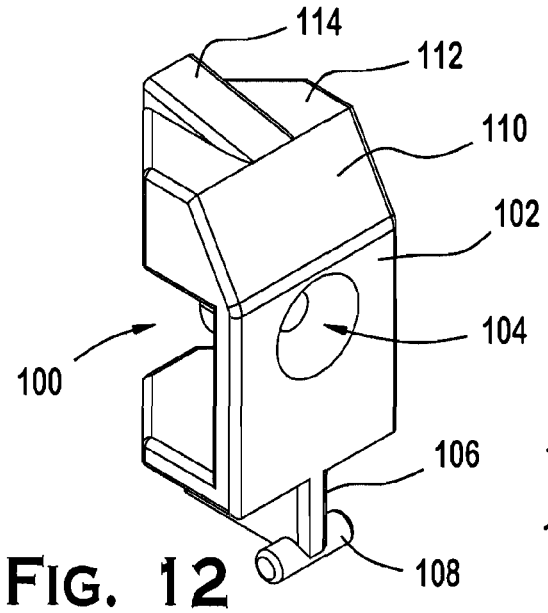
FIG. 12 is a left perspective view of a preferred anchor geometry.
Figure 13:
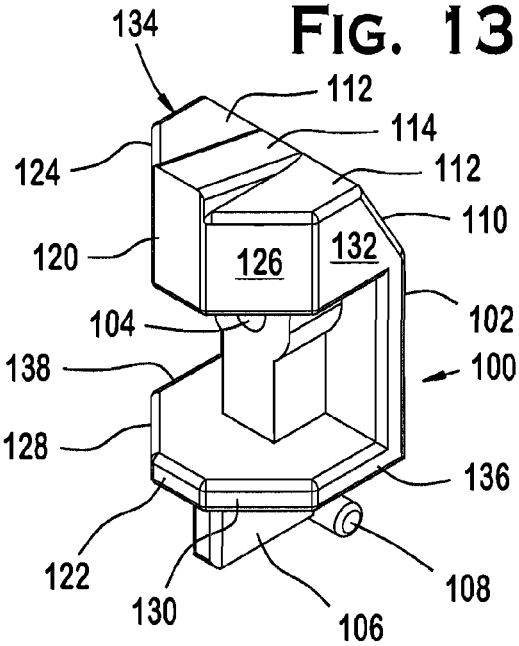
FIG. 13 is a rear perspective view of the anchor of FIG. 12.
Figure 14:
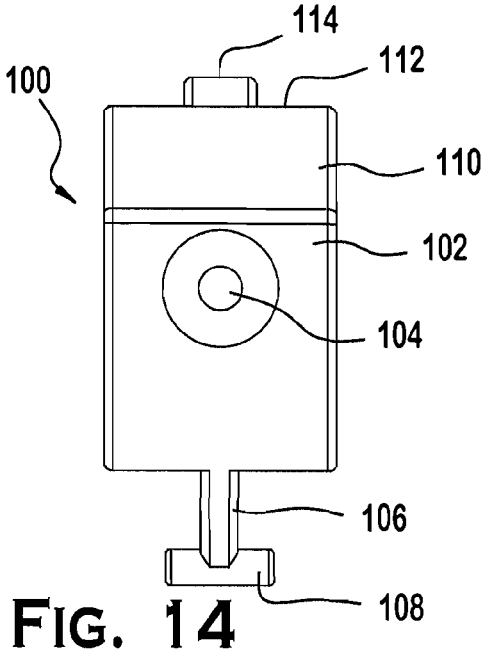
FIG. 14 is a front plan view of the anchor of FIG. 12.
Figure 15:
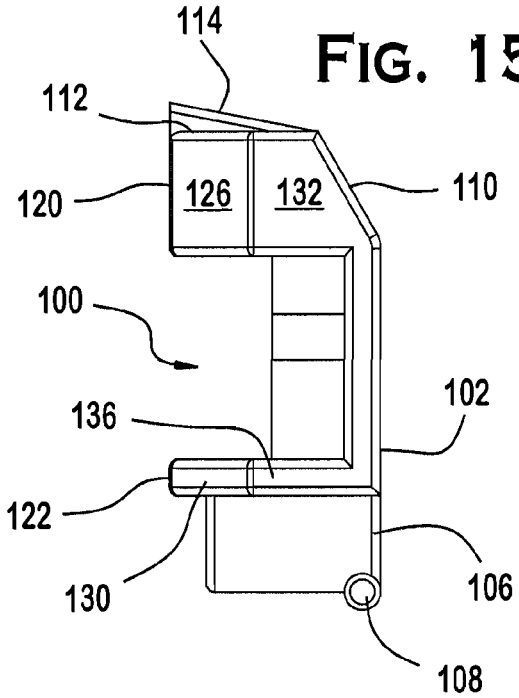
FIG. 15 is a side elevation of the anchor of FIG. 12 with the other side being the mirror image thereof.
Figure 16:
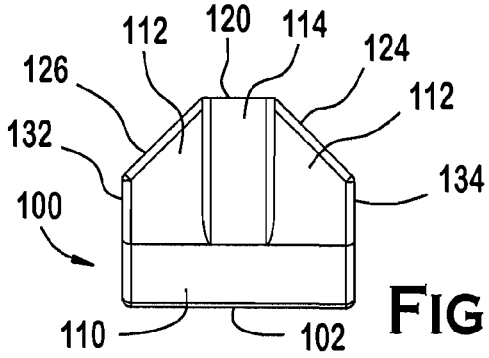
FIG. 16 is a top plan view of the anchor of FIG. 12.
Figure 17:
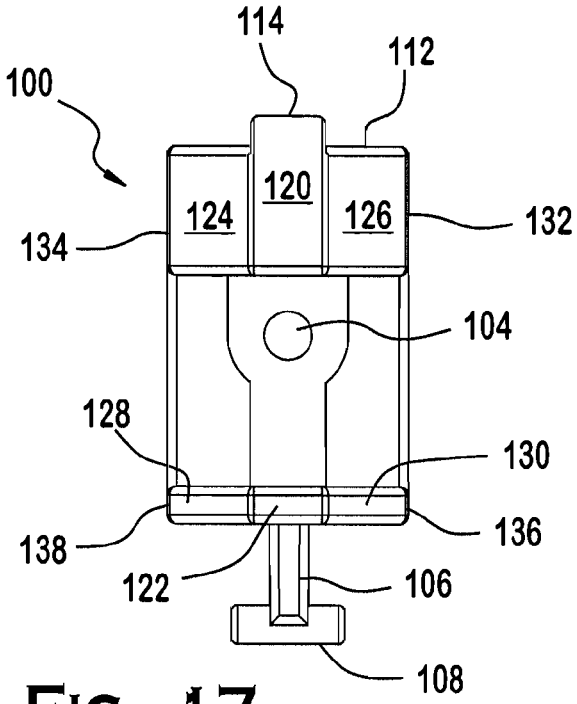
FIG. 17 is a rear plan view of the anchor of FIG. 12.
Figure 18:
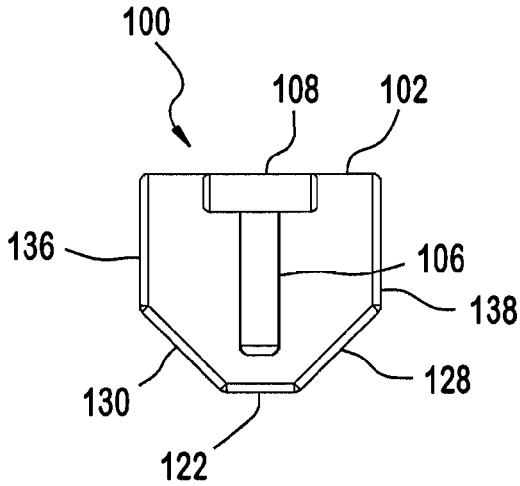
FIG. 18 is a bottom plan view of the anchor of FIG. 12.
Figure 19:
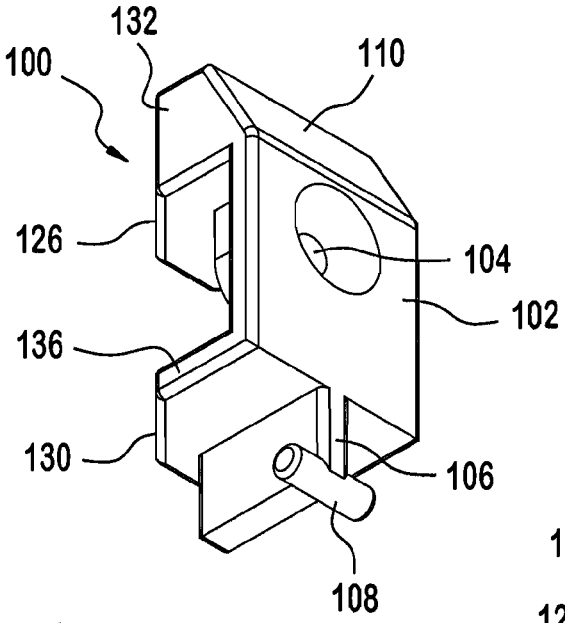
FIG. 19 is a bottom left perspective of the anchor of FIG. 12.
Figure 20:
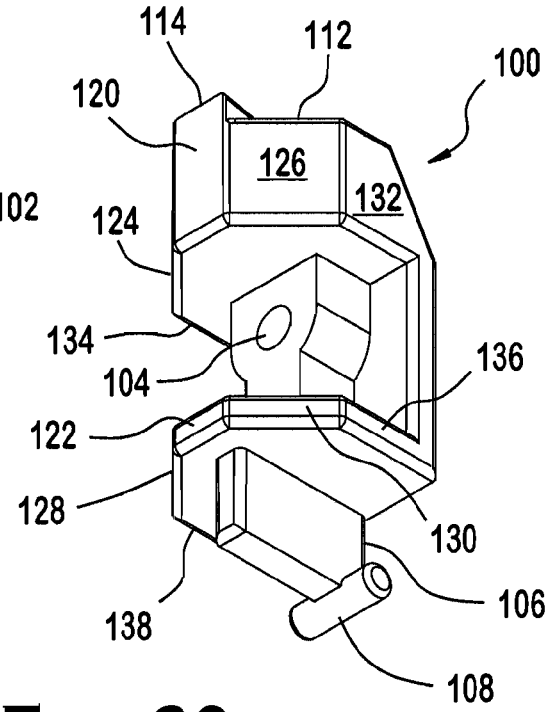
FIG. 20 is a bottom rear perspective of the anchor of FIG. 12.

With reference to FIG. 4, there is shown an illustration of how the hollow object or member 200 fits between the anchors 100 and the walls 30. The method for creating that space is illustrated in FIGS. 5 and 6. Each of the slots 40 illustrated in this embodiment has a "T" like configuration comprised of generally perpendicular slots 50 and 52. The slots 50 and 52 are configured to receive the vertical guide rail 106 and dependent retainer 108 respectively. As seen in FIGS. 5 and 6, the anchor 100 is positioned with the retainer 108 over the slot 52 and the guide rail 106 is over the slot 50. Once the anchor is inserted, it is moved inwardly so that the space 34 is available to receive the desired object when all of the anchors are positioned as illustrated in FIG. 4.

As illustrated in FIGS. 8 through 10, a fastener, which may be a bolt, a screw, a rivet or another connecting means, such as screw 42, is passed through a preferably pre-formed aperture 32 in wall 30 and into the aperture 104 in anchor 100. As the fastener is tightened in aperture 104, the anchor 100 is drawn toward the wall 30 until the inserted object 200 is pinched or compressed between the anchor 100 and the wall 30. The anchor 100 remains in abutment against the floor 36 because the inserted object occupies space over the slot 52 and prevents vertical movement of the retainer 108. It will be appreciated that the dimensions of slot 52 will need to take into account the retainer 108 and the available space.

As noted previously, the preferred geometry of the anchors 100 is illustrated in FIGS. 12 through 20. This preferred anchor geometry keeps the anchor balanced and provides a low center of gravity that resist tilting of the anchor 100 when it is being drawn toward the wall 30. With reference again to FIG. 12, the anchors 100 have a face 102 that includes a fastener aperture 104, a lower vertical guide rail 106 and a retainer 108. Above the face 102, there is a slanted surface 110 which terminates in flat surfaces 112 and the vertically inclined ramp 114. On the back or side opposite the face 102, the anchor has vertical faces 120 and 122 that generally lie in the same plane and essentially determine the depth of the anchor 100. On either side of the vertical faces 120 and 122 are the respective angled surfaces 124 and 126, and 128 and 130. The angled surfaces 124 and 126 are tapered toward face 102 until they meet the respective side wall 132 or 134. Side walls 132 and 134 determine the width of anchor 100. The angled surfaces 128 and 130 are tapered toward face 102 until they meet the respective side wall 138 or 136. The side walls are generally in the same vertical plane. As can be seen in FIGS. 4, 5 and 6, the anchors are preferably dimensioned so that the back surfaces are complementary and fit together when they are moved toward the center of the surface mount 20.

Figure 22:
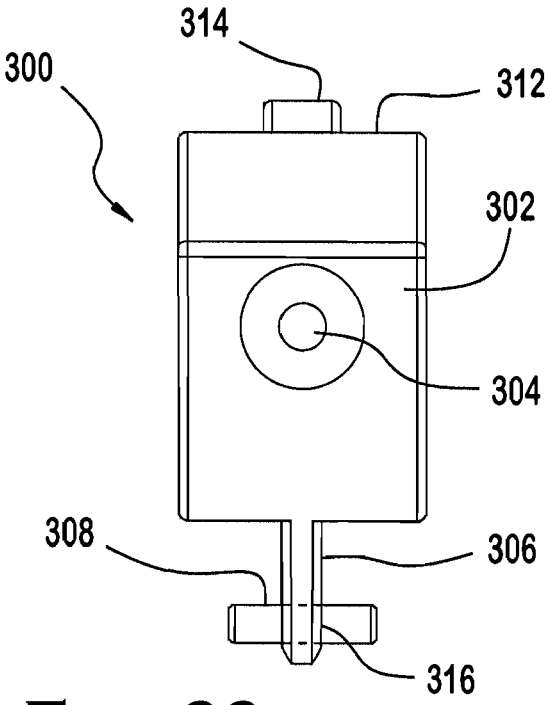
FIG. 22 is a side elevation of the anchor of FIG. 21.
Figure 21:
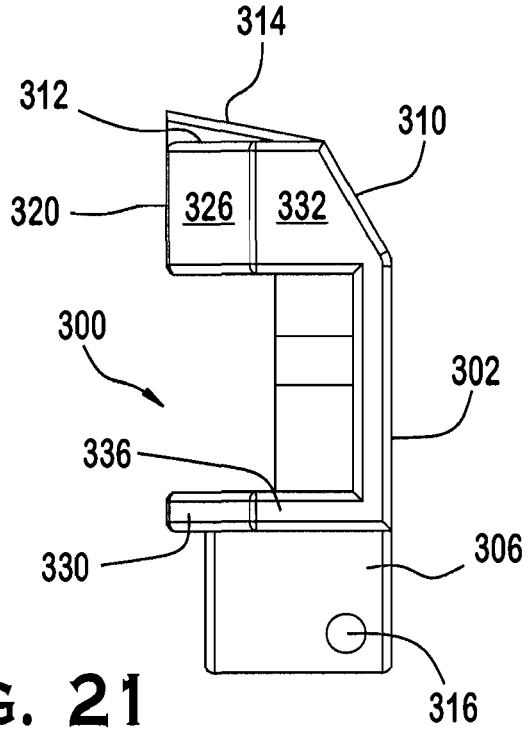
FIG. 21 is a front plan view of an alternative anchor geometry.
Figure 23:
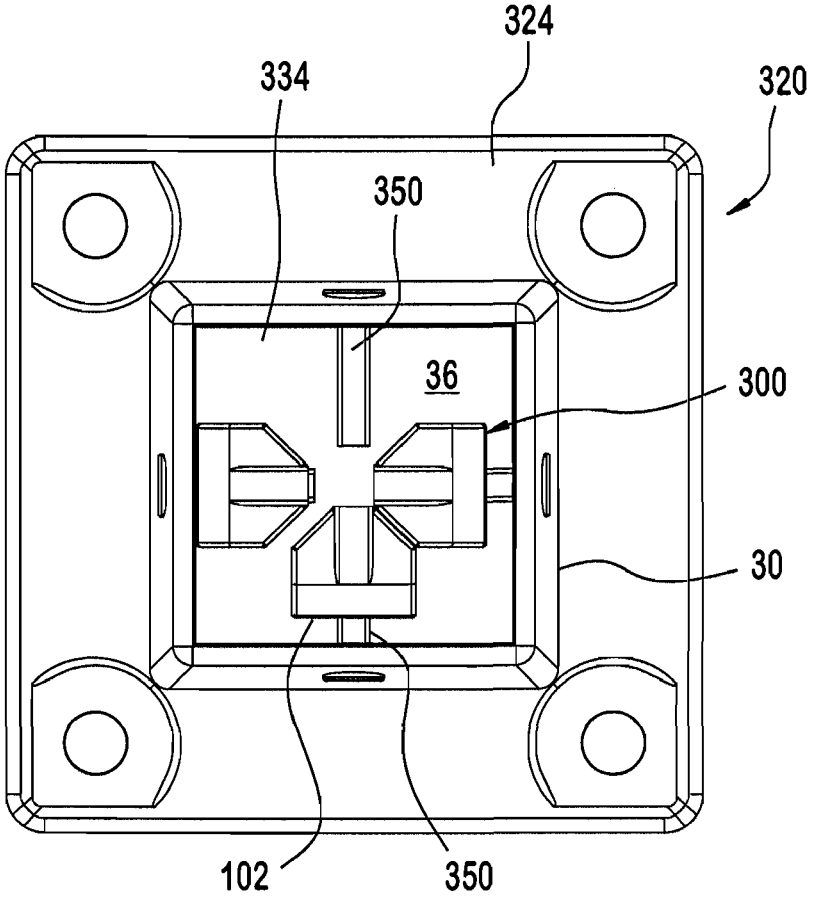
FIG. 23 is a top plan view that illustrates a base that is can be used with the anchor illustrated in FIGS. 21 and 22.

With reference to FIGS. 21 through 23, there is shown an alternative embodiment of the invention. In this embodiment, the anchor 300 does not include a retainer 108 as described previously. In keeping with the configuration of anchor 300, there is continuous single slot 350 in the floor 36, because the continuous guide rail 306 does not require the crossing slot. The guide rail 306 includes an aperture 316 that is positioned below the floor 36 and receives a retainer 308. Once inserted, retainer 308 maintains the anchor 300 in the slot 350. This anchor may be used in application where the available tolerances make the anchor 100 more difficult to use. Here, the guide rail 306 passes through the slot 350 and the retainer 308 is inserted without the need for the crossing slot of the prior embodiment. As a result, there is no concern about the dimension of the inserted object. It will be appreciated that the anchor 300 may be used with the base 20 and that the location of the aperture 316 may be varied by application.

What is claimed is:

1. A combination of a surface mount and a hollow object mounted thereon comprising:

the hollow object comprising a wall having a predefined shape; and the mount, wherein the mount comprises:

a base comprising:

a floor having at least one slot extending therethrough; and a wall structure, extending generally perpendicular from the floor, having exterior and interior surfaces, the interior surfaces defining an interior cavity for receiving the hollow object;

at least one anchor that includes a guide rail retained by and movable within the at least one slot and presents a face surface that is positioned opposite the interior surface of the wall structure; the interior surface and the face surface defining a space in which the hollow object is received; and at least one fastener that is a distinct element from the at least one anchor and includes a head that abuts the exterior surface of the wall structure and a shaft that passes through the wall structure and engages the anchor such that when the fastener is actuated, the anchor is drawn through the slot and towards the wall structure to clamp the wall of the hollow object therebetween;

wherein the at least one fastener and the at least one anchor are equal in number.

2. The combination of claim 1 wherein the at least one slot comprises at least three slots and the at least one anchor comprises at least three anchors.

3. The combination of claim 1 wherein the at least one slot comprises at least four slots and the at least one anchor comprises at least four anchors.

4. The combination of claim 1 wherein the cavity is rectangular.

5. The combination of claim 1 wherein the cavity is square.

6. The combination of claim 1 wherein the at least one slot has a "T" shape.

7. The combination of claim 1 wherein the at least one slot comprises at least three slots, each slot having a "T" shape.

8. The combination The mount of claim 7 wherein the cavity is square.

9. The combination of claim 1 wherein the anchor face surface is shaped to complement the predefined shape of the hollow object.

10. The mount of claim 1, wherein the shaft is a threaded shaft that passes through the wall structure and threadably engages the anchor.

* * * * *